US005295370A

United States Patent [19]

Morris

[11] Patent Number: 5,295,370

[45] Date of Patent: Mar. 22, 1994

[54] AIR CONDITIONER

[76] Inventor: Bobby D. Morris, 103 Lake Forest Dr., Greer, S.C. 29651

[21] Appl. No.: 972,818

[22] Filed: Nov. 6, 1992

[51] Int. Cl.[5] ..... F25D 9/00

[52] U.S. Cl. ..... 62/403; 62/499

[58] Field of Search ..... 62/403, 499; 165/86

[56] References Cited

U.S. PATENT DOCUMENTS 4,117,695 10/1978 Hargreaves ..... 62/403

4,420,945 12/1983 Digrell ..... 62/499

*Primary Examiner*—Ronald C. Capossela

*Attorney, Agent, or Firm*—Davis, Bujold & Streck

[57] ABSTRACT

An air conditioner comprises a compressing and expanding apparatus which includes a compressing system for compressing air taken into compression chambers in one of two cylinder blocks through an inlet aperture and discharging the air from an outlet aperture, and an expanding system for taking in the compressed air through an entrance aperture into expansion chambers in the other cylinder block and expanding the air therein. The air conditioner further comprises a heat exchanger for cooling positioned in the air flow between an outlet aperture of the compressing system and an entrance aperture of the expanding system. Since air is utilized as the cooling medium for the air conditioner, no air pollution or other problem is caused even if it is released into the atmosphere. Moreover, since multiple chambers are provided to process a large amount of air and since the compressing system and the expanding system are arranged compactly, the compressing and expanding apparatus can be compact.

13 Claims, 7 Drawing Sheets

AIR CONDITIONER

BACKGROUND OF THE INVENTION

This invention relates to an air conditioner, and more particularly to an air conditioner which utilizes air as a cooling or heating medium.

In a conventional air conditioner which employs freon, ammonia, or other refrigerant, the latent heat of vaporization of the refrigerant is utilized to attain heat exchange. According to the closed-cycle operation of such an air conditioner, refrigerant is compressed by a compressor, cooled by a heat exchanger to be liquefied, vaporized by an expansion valve, and again supplied to the compressor.

On the other hand, Japanese Unexamined Patent Application No. S62-102061 discloses another air conditioner which employs air and does not utilize the latent heat of vaporization. In this air conditioner, air is compressed by an compressor, cooled by a heat exchanger, and then adiabatically expanded by an expansion machine for the provision of cooled air.

In the former type of the conditioner, however, freon, ammonia or other refrigerant is released into the air, thereby causing serious atmospheric pollution. The drawback of the latter conditioner is its large size which is inevitable since a great volume of air needs to be circulated and additional components such as a compressor and an expansion machine are required. Additionally, the prior art air conditioners need separate heating and cooling systems and thus become still larger in size in order to effect both heating and cooling of air. Such an air conditioner enabled to both heat and cool air is especially useful when a person in a car is hot at the upper half of the body due to the sunlight through the window and cold at the lower half of the body positioned in the shadow in spring and summer and the independent supplies of cooled air to the upper half and heated air to the lower half are desired, or when heated air should be supplied to a room facing to the north and cooled air to a room facing to the south.

SUMMARY OF THE INVENTION

Wherefore, a first objective of the instant invention is to provide a compact air conditioner which utilizes air as a cooling or heating medium.

A second objective of the invention is to provide an air conditioner which simultaneously heat and cool air and is compact.

The first objective of the invention is readily attained by the provision of an air conditioner comprising a compressing and expanding apparatus which includes a fixed inclined portion or sleeve bent almost at the center with a predetermined angle, a pair of cylinder blocks rotatably attached at both ends of the inclined portion, pistons reciprocatingly inserted into a plurality of apertures formed in the cylinder blocks, chambers defined by the pistons, and piston rods positioned parallel to the inclined portion for connecting the opposed pistons positioned in each of the cylinder blocks. In the compressing and expanding apparatus, a compressing system compresses air taken into the chambers in one of the cylinder blocks and discharges the air from an outlet aperture, and an expanding system takes in the compressed air through an entrance aperture into the chambers in the other cylinder block and expands the air therein. The compressing system and the expanding system operate in accordance with the rotation of at least one of the cylinder blocks. The air conditioner further comprises a heat exchanger for cooling positioned in the air flow between the outlet aperture of the compressing system and the entrance aperture of the expanding system.

According to the air conditioner constructed as above, when one of the cylinder blocks is rotated, the other cylinder block connected with the piston rods is also rotated about the inclined portion. Accordingly, the pistons slide reciprocatingly. The chambers in the compressing system compress air taken in and exhaust the compressed air through the outlet aperture. The compressed air is then cooled by the heat exchanger for cooling. Finally, the chambers in the expanding system expand the air taken from the entrance aperture, and discharge the cooled air into a room to be cooled.

The same function can be attained by a modified air conditioner comprising a compressing and expanding apparatus which includes expansion chambers and compression chambers divided by the pistons instead of the compressing system and the expanding system. The compression chambers positioned at the side opposite to the piston rods compress air taken in and exhaust the compressed air through the outlet aperture. The compressed air is then cooled by the heat exchanger for cooling. Finally, the expansion chambers positioned at the side of the piston rods expand the air taken from the entrance aperture, and discharge the cooled air into a room to be cooled.

The second objective of the present invention is attained by the provision of a further modified air conditioner comprising a compressing and expanding apparatus which includes a fixed inclined portion which may be in the form of a sleeve bent almost at the center with a predetermined angle, first and second cylinder blocks rotatably attached at both ends of the inclined portion, pistons reciprocatingly inserted into a plurality of apertures formed in the cylinder blocks, chambers defined by the pistons, and piston rods positioned parallel to the inclined portion for connecting the opposed pistons positioned in each of the cylinder blocks. The air conditioner further comprises a heat exchanger for heating connected with an outlet aperture of the first cylinder block, and a heat exchanger for cooling connected with an outlet aperture of the second cylinder block.

For heating air, air taken into the chambers in the first cylinder block is compressed and discharged through the outlet aperture. The compressed air then flows to the heat exchanger for heating for effecting heat exchange between the compressed air and air in a room to be heated. For cooling air, air taken into the chambers in the second cylinder block is compressed and discharged through another outlet aperture. The compressed air then flows to the heat exchanger for cooling. The air cooled by the heat exchanger for cooling is then expanded and discharged into the room. The compressing and expanding operation is effected by the rotation of at least one of the cylinder blocks.

DETAILED DESCRIPTION OF THE INVENTION

Figure 1:
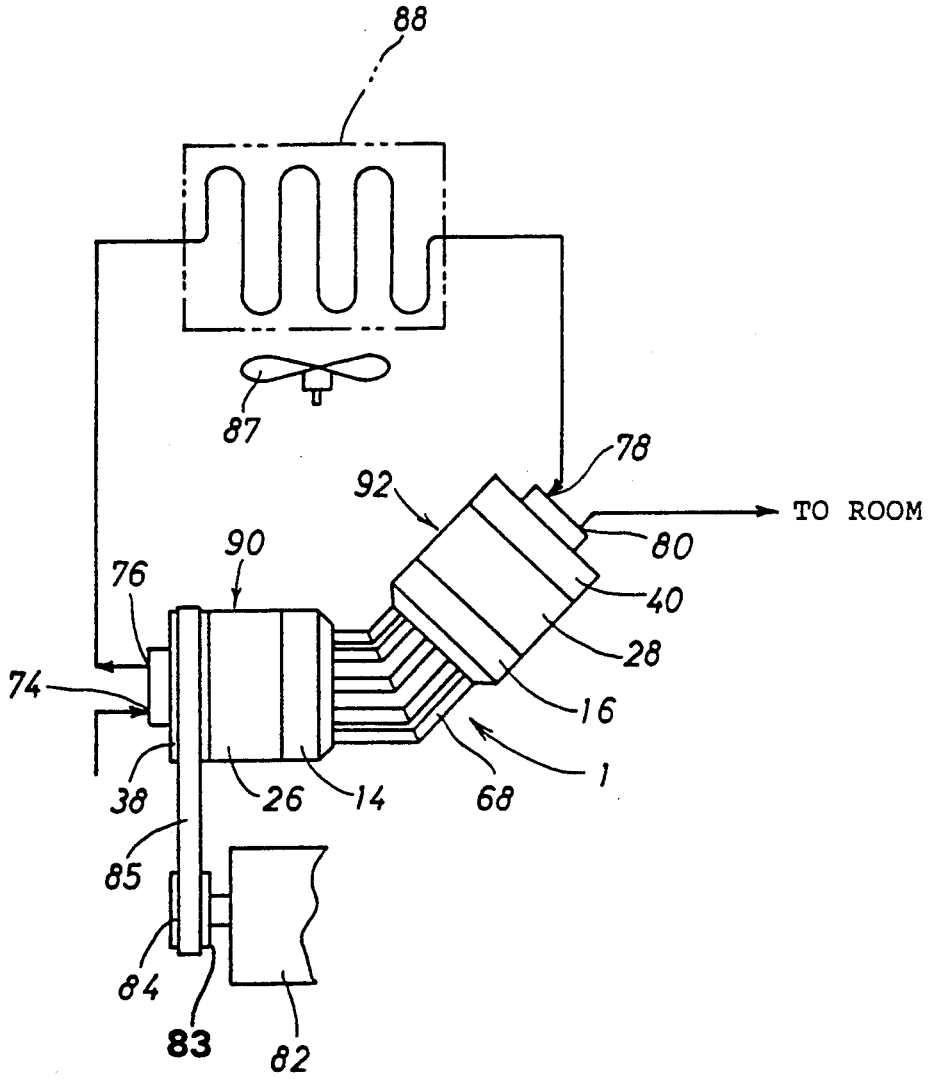
FIG. 1 is a schematic illustration of an air conditioner according to a first embodiment of the present invention.

The first embodiment is described with reference to FIGS. 1, 2, 3A and 3B. As shown in FIG. 2, a compressing and expanding apparatus 1 comprises a fixed inclined sleeve 2 bent almost at the center with a predetermined angle of approximately 45 degrees. The inclined sleeve 2 includes a center 4 having a large diameter, and a shaft 6 at one side of the center 4 and a shaft 8 at the opposite side thereof. Two opposed rod covers 14 and 16 are rotatably attached to the shafts 6 and 8 via bearings 10 and 12, respectively.

Eight through holes 18 and 20 (partially shown in FIG. 2) are formed at regular intervals in the rod covers 14 and 16 and arranged in a circle. The shafts 6 and 8 are rotatably inserted into apertures 22 and 24 provided in the middle of cylinders 26 and 28 adjacent to the rod covers 14 and 16, respectively. Eight apertures 30 and 32 (partially shown in FIG. 2) formed at regular intervals in the cylinders 26 and 28 are concentric with the through holes 18 and 20. The diameter of the apertures 30 is larger than that of the apertures 32.

Communicating grooves 34 and 36 are provided in the cylinders 26 and 28 respectively at the sides opposite to the rod covers 14 and 16, to communicate between the apertures 30, 32 and 22, 24. Head covers 38 and 40 rotatably surround the shafts 6 and 8 via bearings 37*a* and 37*b* adjacent to the cylinders 26 and 28. The outer periphery of the head cover 38 is provided with grooves 42 for receiving a belt 85.

The rod covers 14 and 16, the cylinders 26 and 28, and the head covers 38 and 40 are integrated by a tie rod (not shown), thereby forming cylinder blocks 44 and 46, respectively. The shafts 6 and 8 are respectively provided with collars 48 and 50 and legs 52 and 54. The legs 52 and 54 are attached to the shafts 6 and 8 by means of bolts 56 and 58 and to a fixed base (not shown).

Large pistons 60 having a large diameter and small pistons 62 having a small diameter are slidingly inserted into the respective apertures 30 and 32. Each of the large pistons 60, the cylinder 26, and the head cover 38 define each compression chamber 64, whereas each of the small pistons 62, the cylinder 28, and the head cover 40 define each expansion chamber 66. Each pair of the large pistons 60 and the small pistons 62 is rotatably connected to each end of one of piston rods 68. The piston rods 68 are located parallel to the inclined sleeve 2 and bent almost at the center with an angle of approximately 45 degrees. The large pistons 60 and small pistons 62 are prevented from coming off by means of snap rings 70 and 72.

Figure 3A:
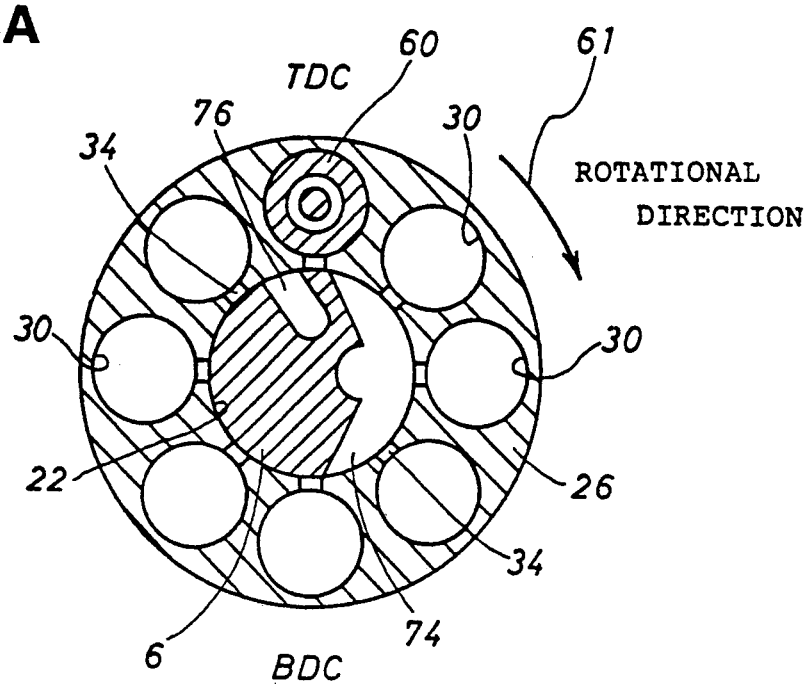
FIG. 3A is a sectional view of the compressing and expanding apparatus for the first embodiment taken along A—A line in FIG. 2.

The shaft 6 is provided with an inlet aperture 74 and an outlet aperture 76 at one end of the shaft. The inlet and outlet apertures 74 and 76 communicate with the side of the compression chambers 64. The shaft 8 is provided with an entrance aperture 78 and an exit aperture 80 at the opposite end of the apparatus. The entrance and exit apertures 78 and 80 communicate with the side of the expansion chambers 66. As shown in FIG. 3A, the inlet aperture 74 reaches the communicating grooves 34 in the axial direction of the shaft 6, and communicates with the compression chambers 64 through the communicating grooves 34 while the large pistons 60 move from a top dead center ("TDC") position to a bottom dead center ("EDC") position in the direction indicated by arrow 61 in FIG. 3A. Also, the outlet aperture 76 communicates with the compression chambers 64 through the communicating grooves 34 just before the large pistons 60 reach the TDC position.

Figure 3B:
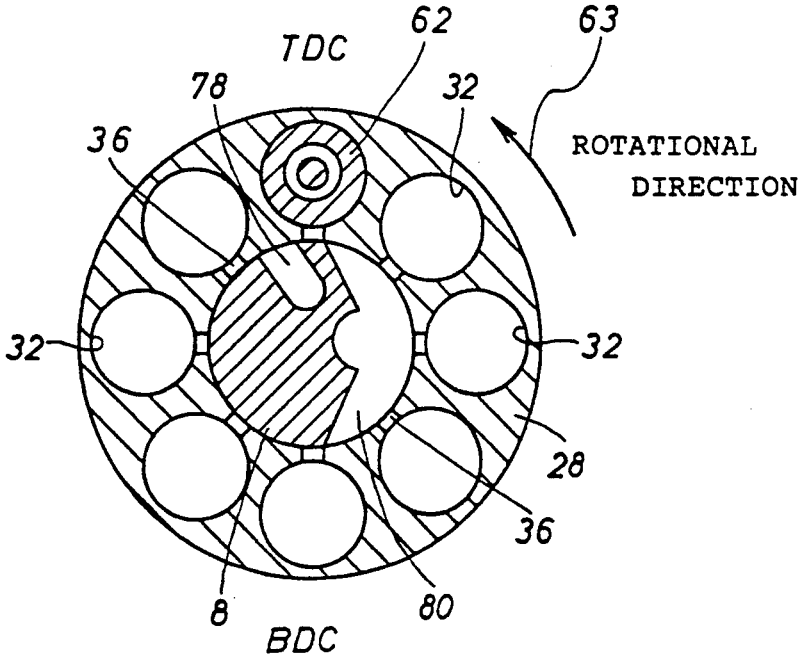
FIG. 3B is a sectional view of the compressing and expanding apparatus for the first embodiment taken along B—B line in FIG. 2.

As shown in FIG. 3B, the entrance aperture 78 connects with the expansion chambers 66 through the communicating grooves 36 just after the small pistons 62 pass the TDC position in the direction indicated by arrow 63 in FIG. 3B. The exit aperture 80 connects with the expansion chambers 66 through the communicating grooves 36 while the small pistons 62 slide from the BDC to the TDC position.

Figure 2:
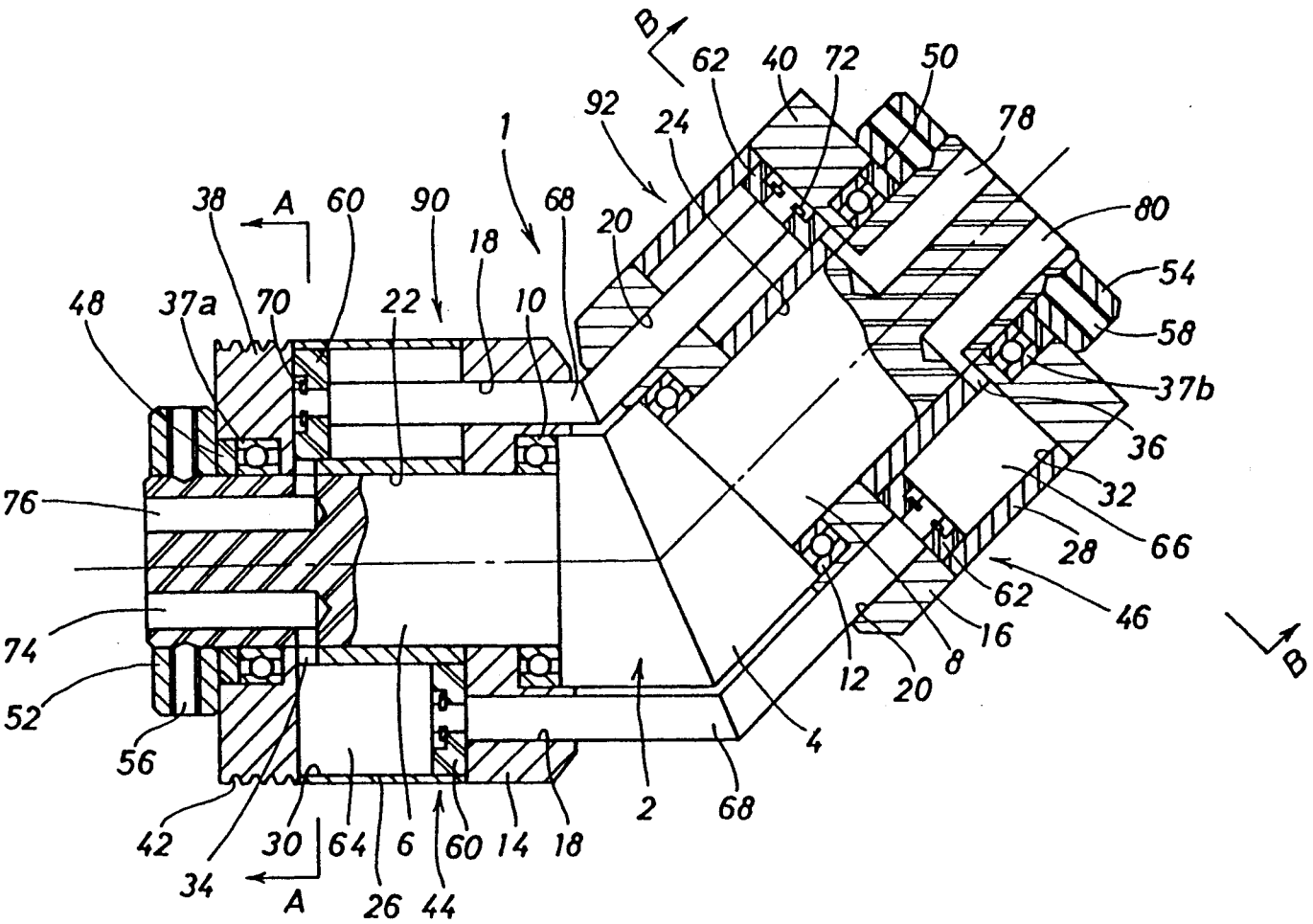
FIG. 2 is a sectional side elevation of a compressing and expanding apparatus for the first embodiment.

Turning to FIG. 1, the grooves 42 formed in the head cover 38 receive the belt 85 which links the head cover 38 with a pulley 84. The pulley 84 is rotated by an engine 82 by means such as an electromagnetic clutch 83. Air enters through the inlet aperture 74 and is discharged through the outlet aperture 76 which communicates with an entrance of a heat exchanger for cooling 88. The heat exchanger for cooling 88 is provided with a fan 87 to cool the air. The air coming from the heat exchanger for cooling 88 enters the entrance aperture 78. Finally, the air is exhausted from the exit aperture 80 via a duct or other passage (not shown) into a room to be cooled.

A compressing system 90 shown in FIG. 1 is composed of the shaft 6, the cylinder block 44, and the piston rods 68. An expanding system 92 is composed of the shaft 8, the cylinder block 46, and the piston rods 68. The compressing system 90 and the expanding system 92 form the compressing and expanding apparatus 1.

In operation, the engine 82 is activated to rotate the pulley 84 by means such as the electromagnetic clutch. The rotation of the pulley 84 is transmitted through the belt 85 to the head cover 38. The cylinder block 44 is then rotated around the inclined sleeve 2, and accordingly, the cylinder block 46 is also rotated about the sleeve 2 via the piston rods 68. As a result of the rotation of the piston rods 68, the large pistons 60 and the small pistons 62 slide within the apertures 30 and 32, respectively.

As shown in FIG. 3A, while the large pistons 60 move from the TDC to the BDC position, the compression chambers 64 expand and take in air from the inlet aperture 74 through the communicating grooves 34. When the large pistons 60 are at the BDC position, the communicating grooves 34 are closed by the shaft 6. When the large pistons 60 pass from the BDC to the TDC position, the compression chambers 64 are compressed, thereby raising the temperature of the air in the compression chamber 64.

When the large pistons are just before the TDC position, the compressed air is discharged from the outlet aperture 76 through the communicating grooves 34. The compression ratio of the large pistons 60 is arranged such that the temperature of the compressed air is raised above 60°-80° C. so as to be sterilized. The compressed air from the outlet aperture 76 is then supplied to the heat exchanger for cooling 88, which achieves heat exchange between the compressed air and the atmosphere. Then, the air cooled by the heat exchanger for cooling 88 is supplied to the entrance aperture 78.

The small pistons 62 slide within the apertures 32 in accordance with the rotation of the other cylinder block 46 about the inclined sleeve 2. Just after the small pistons 62 pass the TDC position, the expansion chambers 66 take in the compressed air from the entrance aperture 78 through the communicating grooves 36. Until the small pistons 62 reach the BDC position, the communicating grooves 36 are closed by the shaft 8. The compressed air in the expansion chambers 66 expands, thereby reducing its temperature. At the same time, a force for rotating the cylinder block 46 about the inclined sleeve 2 is generated since the compressed air tries to expand in the expansion chambers 66 and slide the small pistons 62. While the small pistons 62 move from the BDC to the TDC position, the communicating grooves 36 communicate with the exit aperture 80. The cooled air in the expansion chambers 66 is then supplied through the exit aperture 80 into a room to be cooled.

According to the first embodiment of the present invention, the compact arrangement of the compressing system 90 positioned at one side of the inclined sleeve 2 and the expanding system 92 at the opposite side can reduce the size of the compressing and expanding apparatus 1. Moreover, since the compressing system 90 and the expanding system 92 are rotated by the rotation of only the cylinder block 44, the compressing and expanding apparatus 1 can be further miniaturized.

The apparatus illustrated in FIGS. 4, 5, 6A and 6B is a second embodiment of the present invention and includes compressing and expanding apparatus 101 of similar general construction to the compressing and expanding apparatus 1 of the first embodiment, and similar reference numerals have been given to similar components but 100 has been added to the numerals to distinguish them from the reference numerals of the first embodiment. Since the similar components of the second embodiment have similar construction and function to the first embodiment, further description regarding the similar components is omitted herein.

Figure 5:
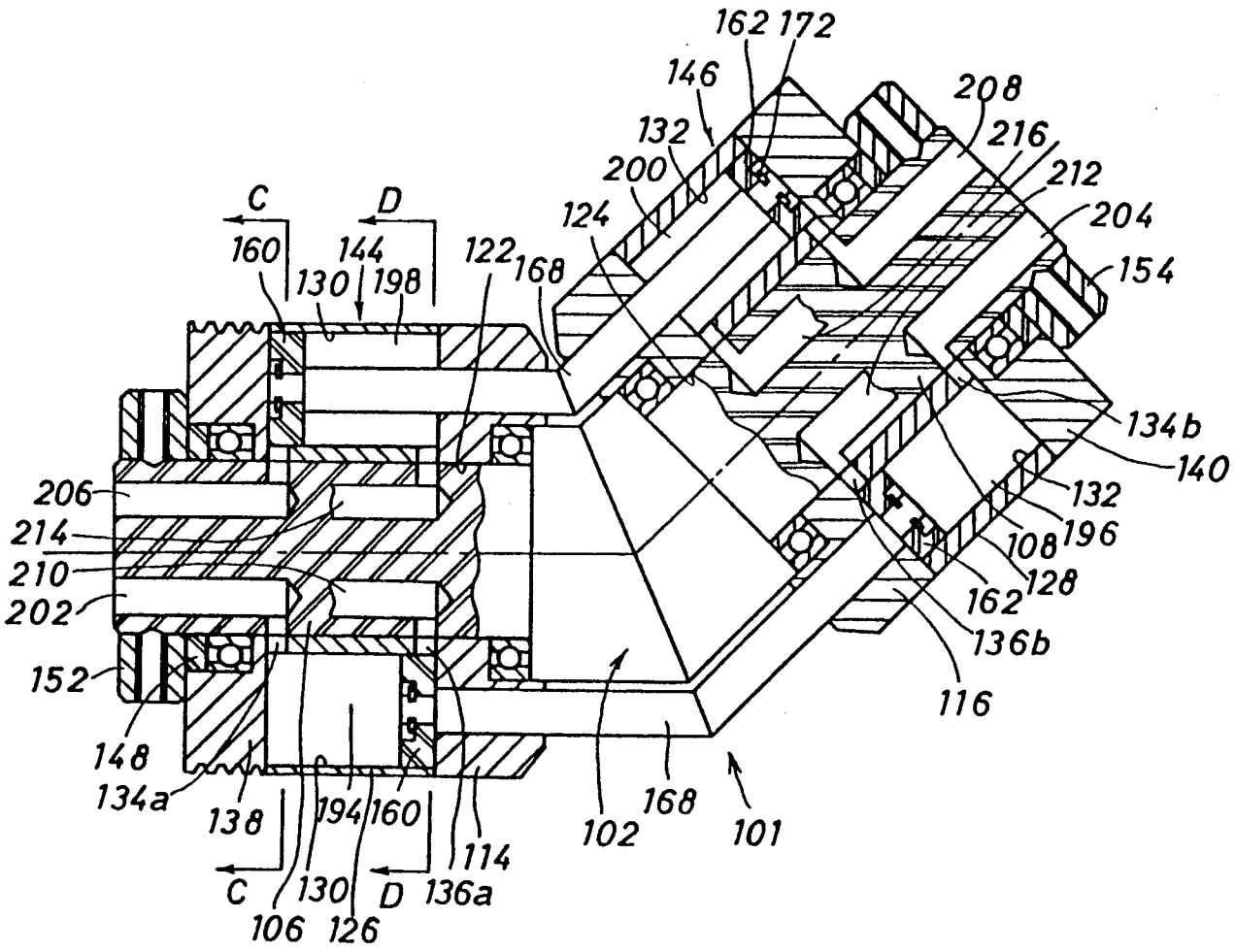
FIG. 5 is a sectional side elevation of a compressing and expanding apparatus for the second and third embodiments.

The compressing and expanding apparatus 101 according to the second embodiment of the present invention is enabled to heat and cool air. As illustrated in FIG. 5, unlike the compression chambers 64 and the expansion chambers 66 in the first embodiment, compression chambers 194 and 196 are defined by cylinders 126 and 128, head covers 138 and 140, and pistons 160 and 162, and expansion chambers 198 and 200 are defined by cylinders 126 and 128, rod covers 114 and 116, pistons 160 and 162. In other words, the compression chambers 194 and 196 are positioned between the pistons 160, 162 and the head covers 138, 140 within the cylinder blocks 144 and 146, and the expansion chambers 198 and 200 are located between the pistons 160, 162 and the rod covers 114, 116 within the cylinder blocks 144 and 146. The pistons 160 and 162 need not have different diameters in this embodiment.

Communicating grooves 134*a* and 134*b* for connecting apertures 122, 124 and the compression chambers 194, 196 are formed at one end of the cylinders 126 and 128 adjacent to the head covers 138 and 140. Communicating grooves 136*a* and 136*b* for connecting the apertures 120, 122 and the expansion chambers 198 and 200 are formed at the opposite end of the cylinders 126 and 128 adjacent to the red covers 114 and 116.

Figure 6A:
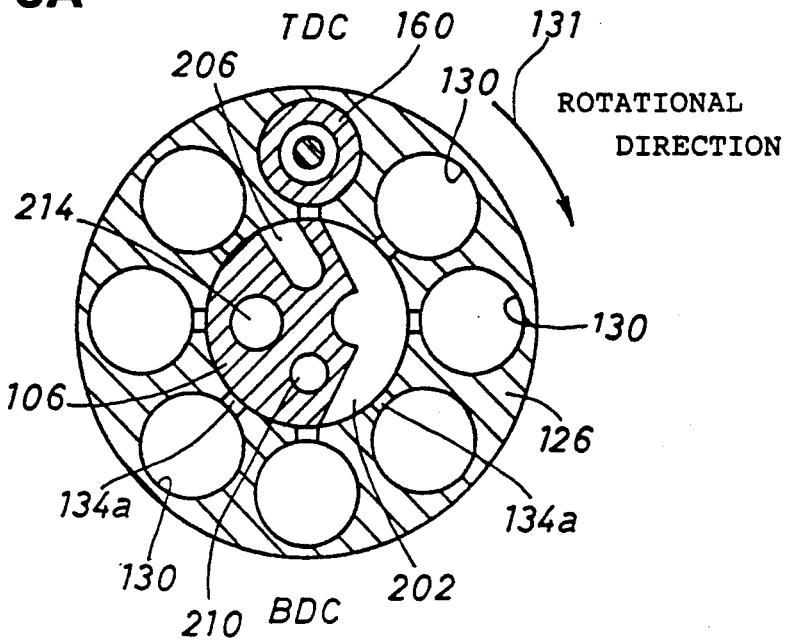
FIG. 6A is a section view of the compressing and expanding apparatus for the second and third embodiments taken along C—C line in FIG. 5.

Inlet apertures 202 and 204 and outlet apertures 206 and 208 are respectively provided at both ends of the inclined sleeve 102 in the axial direction. Though FIG. 6A shows only a cylinder 126 and its related components, another cylinder 128 and its related components have the same construction and function. As shown in the figure, the inlet apertures 202 and 204 reach the communicating grooves 134*a* and 134*b*. While the pistons 160 and 162 move from the TDC to the BDC position in accordance with the rotations of the cylinder blocks 144 and 146 in the direction shown by arrow 131 in FIG. 6A, the inlet apertures 202 and 204 communicate with the compression chambers 194 and 196 through the communicating grooves 134*a* and 134*b*. Just before the pistons 160 and 162 reach the TDC position, the outlet apertures 206 and 208 connect with the compression chambers 194 and 196 through the communicating grooves 134*a* and 134*b*.

Figure 6B:
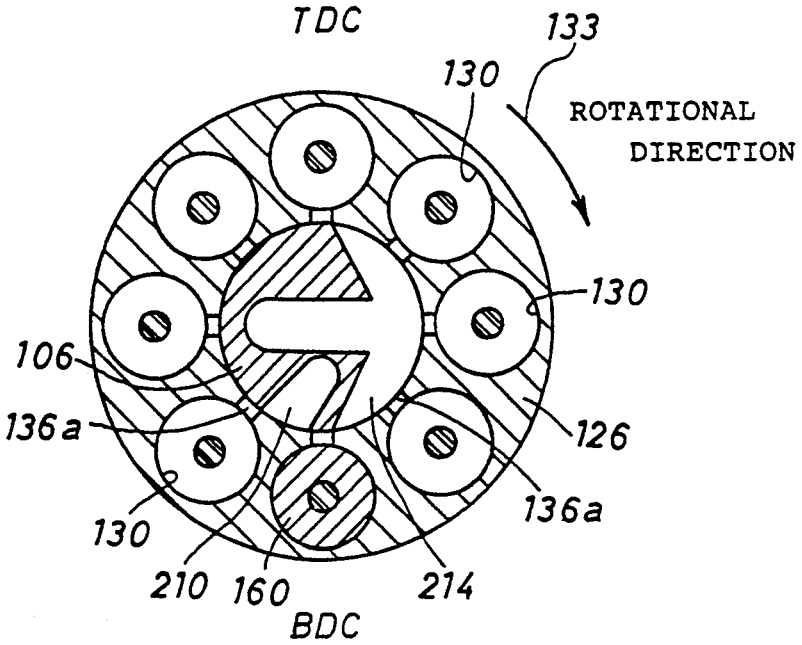
FIG. 6B is a section view of the compressing and expanding apparatus for the second and third embodiments taken along D—D line in FIG. 5.

Entrance apertures 210 and 212 and exit apertures 214 and 216 are respectively provided at both ends of the inclined sleeve 102 parallel to the inlet apertures 202, 204 and the outlet apertures 206, 208. Though FIG. 6B shows only the cylinder 126 and its related components, the cylinder 128 and its related components have the same construction and function. As shown in the figure, the entrance apertures 210 and 212 communicate with the expansion chambers 198 and 200 through the communicating grooves 136*a* and 136*b* just after the pistons 160 and 162 pass the BDC position in the direction shown by arrow 133 in FIG. 6B. While the pistons 160 and 162 move from the TDC to the BDC position, the exit apertures 214 and 216 connect with the expansion chambers 198 and 200 through the communicating grooves 136*a* and 136*b*.

Figure 4:
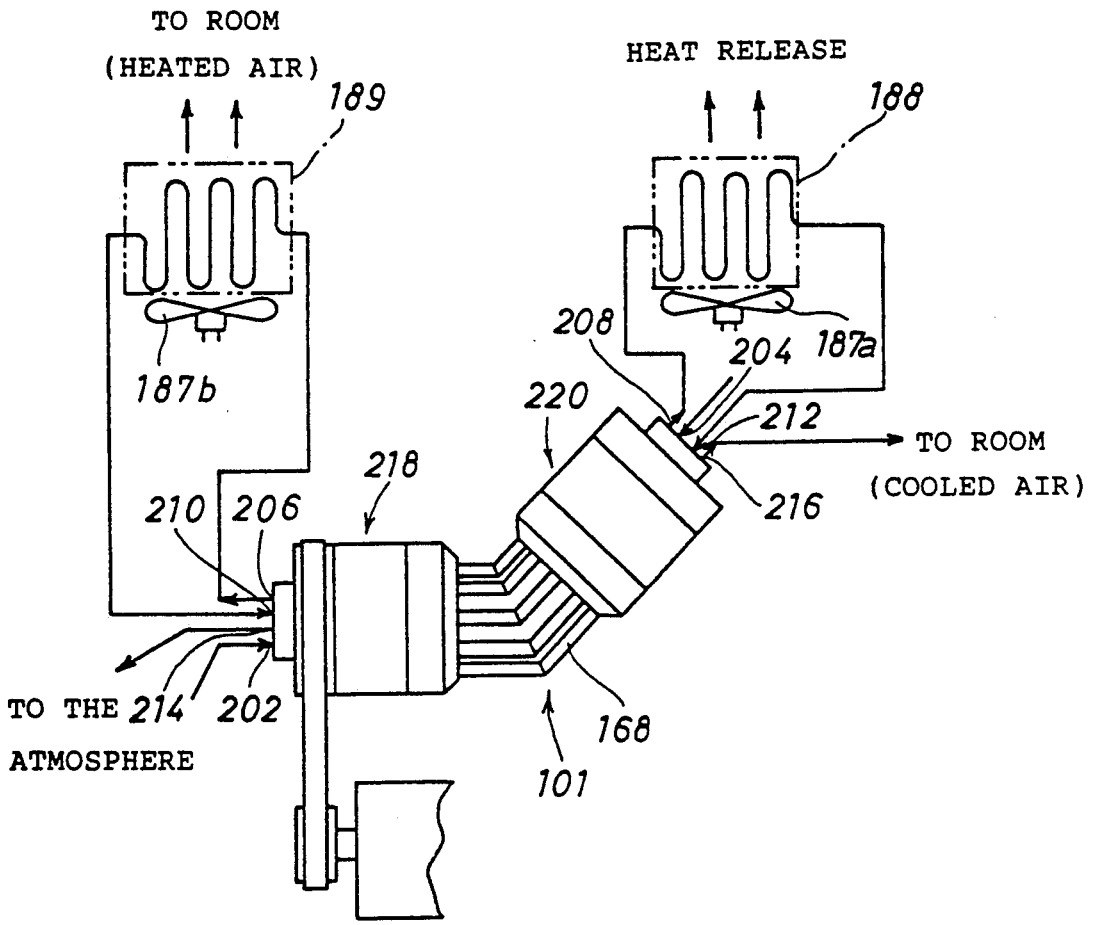
FIG. 4 is a schematic illustration of an air conditioner according to a second embodiment of the present invention.

Turning to FIG. 4, the compressing and expanding apparatus 101 is composed of a compressor for heating 218 and a compressor for cooling 220. The compressor for heating 218 includes a shaft 106, the cylinder block 144, and the piston rods 168. The compressor for cooling 220 includes a shaft 108, the cylinder block 146, and the piston rods 168. The inlet aperture 202 of the compressor for heating 218 takes in air. The outlet aperture 206 of the compressor for heating 218 connects with an entrance of a heat exchanger for heating 189 having a fan 187*b*. An exit of the heat exchanger for heating 189 communicates with the entrance aperture 210 of the compressor for heating 218. Thus, the air flow is arranged such that the air taken into the compressor for heating 218 and discharged from the outlet aperture 206 flows through the heat exchanger for heating 189 to the entrance aperture 210 of the compressor for heating 218. The air is finally discharged from the exit aperture 214 of the compressor for heating 218 into the atmosphere. The heat exchanger for heating 189 attains heat exchange between the air from the outlet aperture 206 and the outside air or air in a room to be heated, thereby supplying heated air to the room. The outside air or air in the room is sent by the fan 187*b*. The heated air can be arranged to flow to the lower position in a car.

The inlet aperture 204 of the compressor for cooling 220 takes in the outside air or air in a room. The outlet aperture 208 connects with an entrance of a heat exchanger for cooling 188 having a fan 187*a*. An exit of the heat exchanger for cooling 188 communicates with the entrance aperture 212 of the compressor for cooling 220. The exit aperture 216 of the compressor for cooling 220 supplies cooled air through duct or other passage (not shown) to the room. The cooled air can be arranged to flow to a higher position in a car room.

In operation, when the cylinder block 144 is rotated around the inclined sleeve 102 in the same manner as described in the first embodiment, the pistons 160 slide within the apertures 130. While the pistons 160 move from the TDC to the BDC position, the compression chambers 194 expand and take in air from the inlet apertures 202 through the communicating grooves 134*a*. When the pistons 160 are at the BDC position, the communicating grooves 134*a* are closed by the shaft 106.

When the pistons 160 slide from the BDC to the TDC position, the air in the compression chambers 194 is compressed, thereby increasing its temperature. The compression chambers 194 communicate with the outlet aperture 206 through the communicating grooves 134*a* just before the pistons 160 reach the TDC position, thereby discharging the compressed air from the outlet aperture 206.

The compressed air from the outlet aperture 206 is supplied to the heat exchanger for heating 189, where heat exchange between the compressed air and the outside air is effected. The compressed air having released heat goes to the entrance aperture 210. As shown in FIG. 6B, the compressed air is then taken into the expansion chambers 198 just after the pistons 160 pass the BDC position. The communicating grooves 136*a* are then closed by the shaft 106 in accordance with the rotation of the cylinder block 144. Thus, the compressed air contained in the expansion chambers 198 tries to expand, thereby sliding the pistons 160.

Accordingly, a force for rotating the cylinder block 144 about the inclined sleeve 102 is generated. While the pistons 160 slide from the TDC to the BDC position, the communicating grooves 136*a* connect with the exit aperture 214. The air having expanded in the expansion chambers 198 and thus reduced its temperature is discharged through the exit aperture 214 into the atmosphere.

On the other hand, when the cylinder block 146 is rotated about the inclined sleeve 102 in accordance with the rotation of the cylinder rod 168, the pistons 162 slide within the apertures 132. While the pistons 162 move from the TDC to the BDC position, the compression chambers 196 expand and take in air from the inlet aperture 204 through the communicating grooves 134*b* in the same manner as in FIG. 6A. When the pistons 162 are at the BDC position, the communicating grooves 134*b* are closed by the shaft 108. When the pistons 162 slide from the BDC to the TDC position, the air in the compression chambers 196 is compressed, thereby increasing its temperature. Then, the compression chambers 196 communicate with the outlet aperture 208 through the communicating grooves 134*b* and the compressed air is discharged from the outlet aperture 208.

The compressed air from the outlet aperture 208 is supplied to the heat exchanger for cooling 188, where heat exchange between the compressed air and the atmosphere is attained. The compressed air thus cooled goes to the entrance aperture 212. The compressed air is taken into the expansion chambers 200 through the communicating grooves 136*b* just after the pistons 162 pass the BDC position in the same manner as in FIG. 6B. The communicating grooves 136*b* are then closed by the shaft 108, so that the compressed air in the expansion chambers 200 expands and the temperature of the air is reduced. The compressed air thus slides the pistons 162. Accordingly, a force for rotating the cylinder block 146 around the inclined sleeve 102 is generated. While the pistons 162 slide from the TDC to the BDC position, the communicating grooves 136*b* connect with the exit aperture 216. The cooled air in the expansion chambers 200 flows through the exit aperture 214 to a room to be cooled or to a higher position in a car.

According to the second embodiment of the present invention, the compact arrangement of the compressor for cooling 218 and the compressor for heating 220 can reduce the size of the compressing and expanding apparatus 101.

Figure 7:
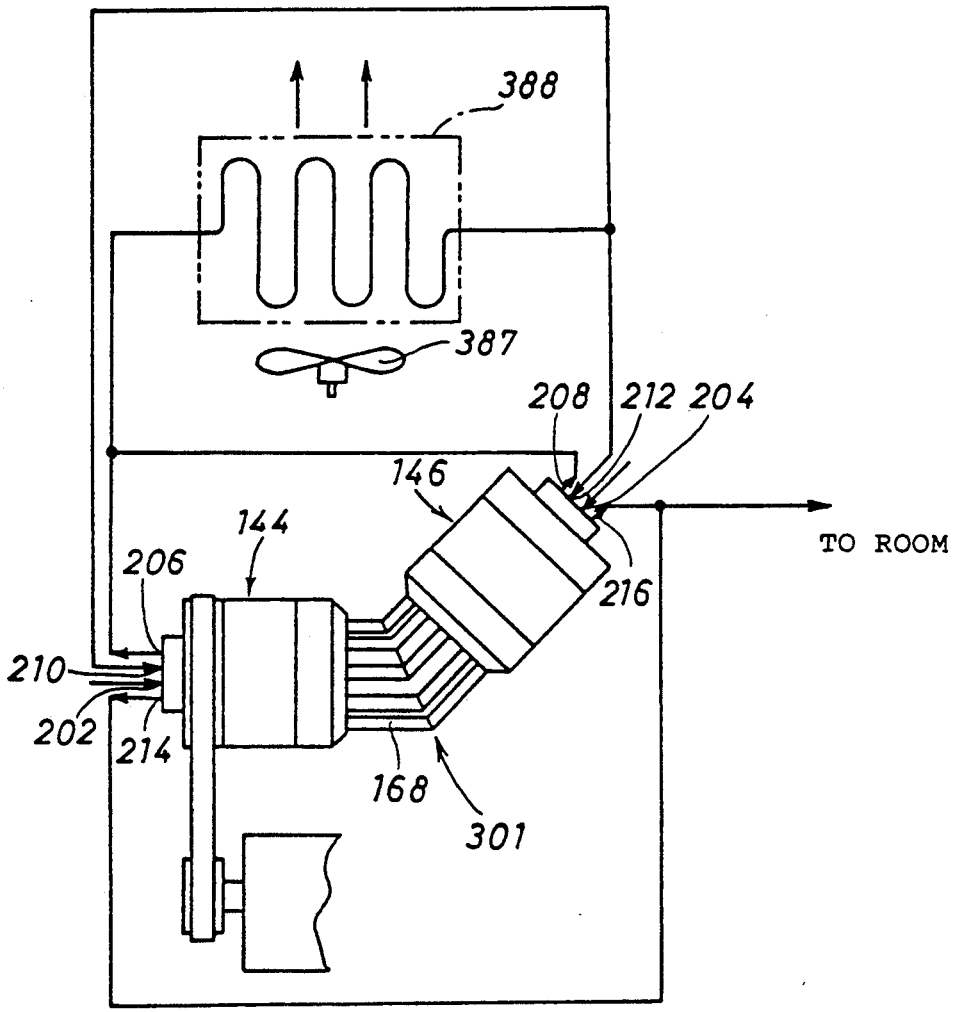
FIG. 7 is a schematic illustration of an air conditioner according to a third embodiment of the present invention.

The apparatus illustrated in FIG. 7 is a third embodiment of a compressing and expanding apparatus 301 of similar general construction to the compressing and expanding apparatuses 1 and 101 of the first and second embodiments, and similar reference numerals have been given to similar components but 300 has been added to the numerals to distinguish them from the reference numerals of the first and second embodiments. Since the compressing and expanding apparatus 301 is the same as the compressing and expanding apparatus 101 of the second embodiment, the third embodiment is described with reference to FIGS. 5, 6A and 6B as well as FIG. 7. For convenience in explaining the third embodiment, the same components as those of the second embodiment in FIGS. 5, 6A, 6B and 7 are denoted by the same reference numerals as in the second embodiment.

The compressing and expanding apparatus 301 of the third embodiment exclusively cools air in a room utilizing the compressing and expanding apparatus 101 constructed according to the second embodiment. As illustrated in FIG. 7, air is taken into inlet apertures 202 and 204. Outlet apertures 206 and 208 connect with an entrance of a heat exchanger for cooling 388 having a fan 387. An exit of the heat exchanger for cooling 388 communicates with entrance apertures 210 and 212. The air flow is arranged such that the air from the outlet apertures 206 and 208 flows via heat exchanger for cooling 388 into the entrance apertures 210 and 212. The air coming from the entrance apertures 214 and 216 then flows through a duct or other passage (not shown) into a room to be cooled.

In operation, piston rods 168 are rotated about an inclined sleeve 102 in accordance with the rotation of cylinder blocks 144 and 146. At the same time, pistons 160 and 162 slide within apertures 130 and 132. When the pistons 160 and 162 slide from the TDC to the BDC position, compression chambers 194 and 196 expand and take in air from the inlet apertures 202 and 204 through communicating grooves 134*a* and 134*b*. When the pistons 160 and 162 are at the BDC position, the communicating grooves 134*a* and 134*b* are closed by shafts 106 and 108. When the pistons 160 and 162 move from the BDC to the TDC position, the air in the compression chambers 194 and 196 is compressed, thereby increasing its temperature. The compression chambers 194 and 196 communicate with the outlet apertures 206 and 208 through the communicating grooves 134*a* and 134*b*, and the compressed air is discharged from the outlet apertures 206 and 208. The compressed air from the outlet apertures 206 and 208 are supplied to the heat exchanger for heating 388, where heat exchange between the compressed air and the atmosphere is attained. The compressed air having released heat then flows into the entrance apertures 210 and 212.

The compressed air coming through the entrance apertures 210 and 212 is taken into expansion chambers 198 and 200 through communicating grooves 136*a* and 136*b* just after the pistons 160 and 162 pass the BDC position. The communicating grooves 136*a* and 136*b* are then closed by the shafts 106 and 108 in accordance with the rotation of the cylinder blocks 144 and 146. The compressed air contained in the expansion chambers 198 and 200 tries to expand, thereby sliding the pistons 160 and 162. Accordingly, a force for rotating the cylinder blocks 144 and 146 about the inclined sleeve 102 is generated. While the pistons 160 and 162 move from the TDC to the BDC position, the communicating grooves 136*a* and 136*b* connect with the exit apertures 214 and 216. The air cooled by the expansion of the expansion chamber 198 and 200 is supplied from the exit apertures 214 and 216 to the room.

As mentioned in conjunction with the preceding embodiments, multiple compression chambers 64, 194, and 196 and the expansion chambers 66, 198 and 200 provided around the inclined sleeves 2, 102 can process a large amount of air. Since air is utilized for air conditioning, no air pollution or other problem is caused even if it is released into the atmosphere. Additionally, in case of cooling air, since the temperature of the compressed air is high enough to sterilize the air, the air conditioner of the present invention can be utilized for an aseptic room. Furthermore, since the compressed air contained in the expansion chambers 66, 198 and 200 tries to expand therein, a force for rotating the cylinder blocks 46, 144 and 146 is generated and helps the engine 82 to rotate the cylinder blocks 44, 46, 144 and 146.

As is readily apparent, numerous modifications and changes may readily occur to those skilled in the art, and hence it is not desired to limit the invention to the exact construction and operation shown and described, and accordingly all suitable modifications and equivalents may be resorted to, falling within the scope of the invention as claimed. For example, the number of the pistons 60, 62, 160 and 162 is not limited to eight, but can be determined freely.

What is claimed is:

1. An air conditioner including a compressing and expanding apparatus, comprising:

a fixed element defining first and second axes intersecting at a central region and including a first shaft projecting from said element along said first axis away from said region and a second shaft projecting from said element along said second axis away from said region;

a first cylinder block rotatably supported on said first shaft and a second cylinder block rotatably supported on said second shaft; each said cylinder block defining a plurality of cylinders each defining a longitudinal axis parallel to the axis of the associated shaft;

a plurality of pistons disposed one in each said cylinder for reciprocation therein;

a plurality of chambers defined in said plurality of cylinders by said plurality of pistons and said cylinder blocks;

a plurality of piston rods defining intersecting axes parallel to said elements intersecting axes and interconnecting pairs of said pistons one in each of said first and second cylinder blocks;

a compressing system, for taking gas into the plurality of chambers of said first cylinder block, and discharging compressed gas from an outlet aperture of said first cylinder block; and an expanding system, for taking the compressed gas into the plurality of chambers of said second cylinder block, and for expanding said compressed gas, wherein said compressed system and said expanding system operate as a result of reciprocation of said pistons in said cylinders resulting from rotation of said first and second cylinder blocks about said shafts.

2. The air conditioner of claim 1 further including drive means, for effecting rotation of said first and second cylinder blocks.

3. The air conditioner of claim 1 further including a heat exchanger, coupled between said compressing system and said expanding system.

4. The air conditioner of claim 3 wherein said heat exchanger is for cooling said gas.

5. The air conditioner of claim 4 wherein said compressed gas is air and is cooled by the heat exchanger for cooling and is expanded by said expanding system for discharge into a room to be cooled.

6. The air conditioner of claim 3 wherein said heat exchanger includes a heat exchanger for heating.

7. The air conditioner of claim 6 wherein said heat exchanger for heating is arranged for heat exchange between the compressed gas and air in a room to be heated.

8. The air conditioner of claim 1 further including a heat exchanger for heating, for effecting heat exchange between said compressed gas and air in a room to be heated; and a heat exchanger for cooling, for cooling the compressed gas being expanded by said expanding system, and for discharging said cooled gas into a room to be cooled.

9. The air conditioner of claim 1 wherein at least one of said first and second cylinder blocks includes both expanding chambers and compressing chambers, for providing compressed gas and expanded gas from said at least one cylinder block.

10. The air conditioner of claim 9 wherein said compressing chambers take in and compress gas, and discharge said compressed gas through an outlet aperture, and wherein said expanding chambers receive said compressed gas from said outlet aperture of said compressing chambers through an entrance aperture.

11. An air conditioner including a compressing and expanding apparatus, comprising:

a fixed element defining and first and second axes intersecting at a central region and including a first shaft projecting from said element along said first axis away from said region and a second shaft projecting from said element along said second axis away from said region;

a first cylinder block rotatably supported on said first shaft and a second cylinder block rotatably supported on said second shaft; each said cylinder block defining a plurality of cylinders each defining a longitudinal axis parallel to the axis of the associated shaft;

a plurality of pistons disposed one in each said cylinder for reciprocation therein;

a plurality of chambers defined in said plurality of cylinders by said plurality of pistons and said cylinder blocks;

a plurality of piston rods defining intersecting axes parallel to said elements intersecting axes and interconnecting pairs of said pistons one in each of said first and second cylinder blocks;

a first compressing system in one of said cylinder blocks, for taking air into a plurality of chambers in one of said cylinder blocks, and for discharging air from a first outlet aperture in said one of said cylinder blocks, said outlet aperture coupled to a heat exchanger for heating, for effecting heat exchange between the compressed air and air in a room to be air conditioned;

a second compressing system in the other of said cylinder blocks, for taking air into a plurality of said chambers in said other one of said cylinder blocks, and for discharging air from a second outlet aperture in said other of said cylinder blocks, said second outlet aperture coupled to a heat exchanger for cooling; and an expanding system, for taking the compressed air cooled by said heat exchanger for cooling through an entrance aperture into a plurality of said chambers in said other one of said cylinder blocks, for expanding said compressed air, said cooled and expanded air being discharged into a room to be air conditioned.

12. An air conditioner including a compressing and expanding apparatus, comprising:

a fixed element defining first and second axes intersecting at a central region and including a first shaft projecting from said element along said first axis away from said region and a second shaft projecting from said element along said second axis away from said region;

a first cylinder block rotatably supported on said first shaft and a second cylinder block rotatably supported on said second shaft; each said cylinder block defining a plurality of cylinders each defining a longitudinal axis parallel to the axis of the associated shaft;

a plurality of pistons disposed one in each said cylinder for reciprocation therein;

a plurality of chambers defined in said plurality of cylinders by said plurality of pistons and said cylinder blocks;

a plurality of piston rods defining intersecting axes parallel to said elements intersecting axes and interconnecting pairs of said pistons one in each of said first and second cylinder blocks;

a compressing system, for taking air into a plurality of compressing chambers in said first and second cylinder blocks, and discharging compressed air from an outlet aperture in each of said first and second cylinder blocks; and an expanding system, for taking the compressed air from said compressing system through an entrance aperture into a plurality of expanding chambers in each of said first and second cylinder blocks, and for expanding said compressed air, wherein said compressing system and said expanding system operate as a result of rotation of said first and second cylinder blocks.

13. The air conditioner of claim 12 further including a heat exchanger for cooling, coupled between outlet aperture of said compressing system and said entrance aperture of said expanding system, for cooling the air discharged from said outlet aperture of said compressing system.

* * * * *